US006006809A

United States Patent [19]

Williams et al.

[11] Patent Number: 6,006,809

[45] **Date of Patent: *Dec. 28, 1999**

[54] SHADE CANOPY

[75] Inventors: Marvin E. Williams; Joseph R. Tartaron, both of Columbus, Ohio

[73] Assignee: CertainTeed Shade Systems, L.L.C., Columbus, Ohio

[ * ] Notice: This patent is subject to a terminal disclaimer.

[21] Appl. No.: 09/135,087

[22] Filed: Aug. 17, 1998

Related U.S. Application Data

[63] Continuation-in-part of application No. 08/784,256, Jan. 15, 1997, Pat. No. 5,794,679.

[51] Int. Cl.[6] ..... E04F 10/00

[52] U.S. Cl. ..... 160/46; 160/84.06

[58] Field of Search ..... 160/46, 66, 84.01, 160/84.06; 47/17; 52/63

[56] References Cited

U.S. PATENT DOCUMENTS

| | | |
|---|---|---|
| 1,106,624 | 8/1914 | Cadwallader et al. . |
| 1,713,452 | 5/1929 | Schiff . |
| 4,557,310 | 12/1985 | Castellaw et al. . |
| 4,647,488 | 3/1987 | Schnebly et al. . |
| 4,655,010 | 4/1987 | Arquati . |
| 4,726,410 | 2/1988 | Fresh . |
| 4,741,375 | 5/1988 | Milford et al. . |
| 4,776,379 | 10/1988 | Kraeutler . |
| 4,854,363 | 8/1989 | Fouquet . |
| 5,026,109 | 6/1991 | Merlot, Jr. . |
| 5,259,432 | 11/1993 | Danieli . |
| 5,265,373 | 11/1993 | Vollebregt . |
| 5,307,855 | 5/1994 | Martensson . |
| 5,379,823 | 1/1995 | Kraeutler . |
| 5,503,210 | 4/1996 | Colson et al. . |
| 5,794,679 | 8/1998 | Williams et al. ..... 160/46 |

OTHER PUBLICATIONS

"Latin Terrace Cover", Mitjavila.

*Primary Examiner*—David M. Purol
*Attorney, Agent, or Firm*—Frank H. Foster; Kremblas, Foster, Millard & Pollick

[57] ABSTRACT

A shade canopy structure has several substantially parallel, but laterally spaced rafter members, each rafter member having longitudinally extending tracks on its laterally opposite sides. The rafters define a plurality of laterally spaced openings. A plurality of cross beams extend laterally between adjacent rafter members and have their ends engaged in the track for sliding along the track. This forms a plurality of laterally spaced tiers of cross beams for each of the laterally spaced openings. A plurality of flexible, laterally spaced opaque sheets, each are extendible along one of the laterally spaced openings and each is attached to a tier of cross beams at spaced locations along the sheet so that each sheet may be independently drawn to an extended position and releasably latched in an extended position, or manually withdrawn to a retracted position.

11 Claims, 14 Drawing Sheets

SHADE CANOPY

This application is a continuation-in-part of our application Ser. No. 08/784,256 filed Jan. 15, 1997 and now U.S. Pat. No. 5,794,679.

TECHNICAL FIELD

This invention relates generally to building structures, and more particularly relates to an inexpensive sun shading structure for use over patios, decks, porches, and the like.

BACKGROUND ART

For human health, as well as human comfort, it is desirable to provide a sun shade above many outdoor living and recreational areas. Such areas include the porches of apartments and condominiums, decks, areas near swimming pools, outdoor restaurants, and other outdoor commercial areas. In warm seasons and in warm climates, on cloudless days, the bright sunlight can make an outdoor area extremely uncomfortable or uninhabitable, particularly where the area has a southern or western exposure. Although trees and other vegetation can provide natural shade, in many areas, particularly areas of recent construction, such vegetation is too small to provide practical shade.

There are a variety of products readily available which attempt to solve this problem. Most, however, are expensive because they include sophisticated mechanisms to enable them to be completely retracted for providing overhead exposure on non-sunny days. The sophisticated mechanical mechanisms typically require precise alignment and adjustment, and require expensive maintenance if they become misaligned. Most prior art overhead shading structures have only a limited or no ability to permit the user to fully or only partially retract selected portions in order to tailor the shaded area to the user's needs at a specific time of day and sun position. Some prior art structures require that a contractor be employed to construct a wooden overhead support structure. There are also considerably less expensive shade structures, but these are permanent awnings or metallic roofs, which cannot be moved to accommodate different weather conditions. Essentially all of these prior art systems require the employment of a contractor or experienced installation professional in order to insure that they are properly installed. This, however, increases the cost of such units.

As a consequence, there is a need for a shade canopy structure which combines the features of being inexpensive, yet strong and sturdy, while also being sufficiently simple and easy to install that it can be installed by do-it-yourself home owners. There is also a need for a canopy which permits the user to tailor the shape and size of the shade area to accommodate the user's layout of furniture and other objects for any desired sun and weather conditions. There is also a need for a canopy shade structure which does not require custom manufacturing, but rather is capable of being constructed from standard components in multiple, modular units so that it can be inexpensively custom fit to essentially any size outdoor area of human habitation. There is also a need for a shade canopy structure which can be very simply and easily manually retracted or extended without requiring complicated mechanisms for winding the shade fabric on a roll and unwinding it.

The prior art illustrates a variety of door and window shading structures having spaced crossbars attached along a ribbon of fabric, with the crossbars sliding in a track on each side of the door or window. Such structures are shown, for example, in U.S. Pat. Nos. 4,647,488; 4,776,379; 5,379,823; and 5,503,210. These devices extend between opposite door sides, to span across a single opening required for a door.

U.S. Pat. No. 5,026,109 shows a similar concept applied to cover the cargo bin portion of a truck. That structure utilizes a rope and pulley mechanism for retracting and extending the cover. U.S. Pat. No. 1,713,452 shows similar concepts applied to a single window shade.

U.S. Pat. No. 1,106,624 shows a partial shade system for orchards which relies upon a plurality of side-by-side ribbons, each ribbon being an at least partially transparent fabric, which is supported by horizontally stretched ropes and rolled up on the ends. While this system allows a selectable contouring of the shaded area, it also requires rolling mechanisms and intermediate ropes to hold it down between the posts. Furthermore, its shade has intermittent, unshaded areas between the fabric ribbons and the tensioning of the support ropes causes the vertical posts to be pulled toward the center, and eventually become tilted in a non-vertical, unsightly orientation.

BRIEF DISCLOSURE OF INVENTION

The invention is a canopy structure comprising at least three substantially parallel, laterally spaced rafter members which form a plurality of laterally spaced openings. Each rafter member has a pair of longitudinally extending tracks on laterally opposite sides of the rafter member. A plurality of movable cross beams extend laterally between adjacent rafter members, and each cross beam has a track engaging member attached to each end, which is slidable along the track. In this manner, the invention forms a plurality of laterally spaced tiers of cross beams. Each tier of cross beams includes a flexible, opaque sheet between and extending longitudinally along the rafters. Each sheet is attached to the cross beams at spaced locations along the sheet. Preferably, there are end locks near each end of the rafter members which engage the endmost cross beams when the flexible sheets are fully extended. The end locks retain the endmost cross beams in position to retain the sheets in an outstretched tension, rather than permitting them to droop in large pleats between the cross beams. The end lock at one end may be permanently attached to the endmost cross beam at one end, while the end lock at the opposite end is releasable so that the sheets may be retracted by the user or automatically released in high wind conditions. The invention also includes several other preferred structural features.

Figure 1:
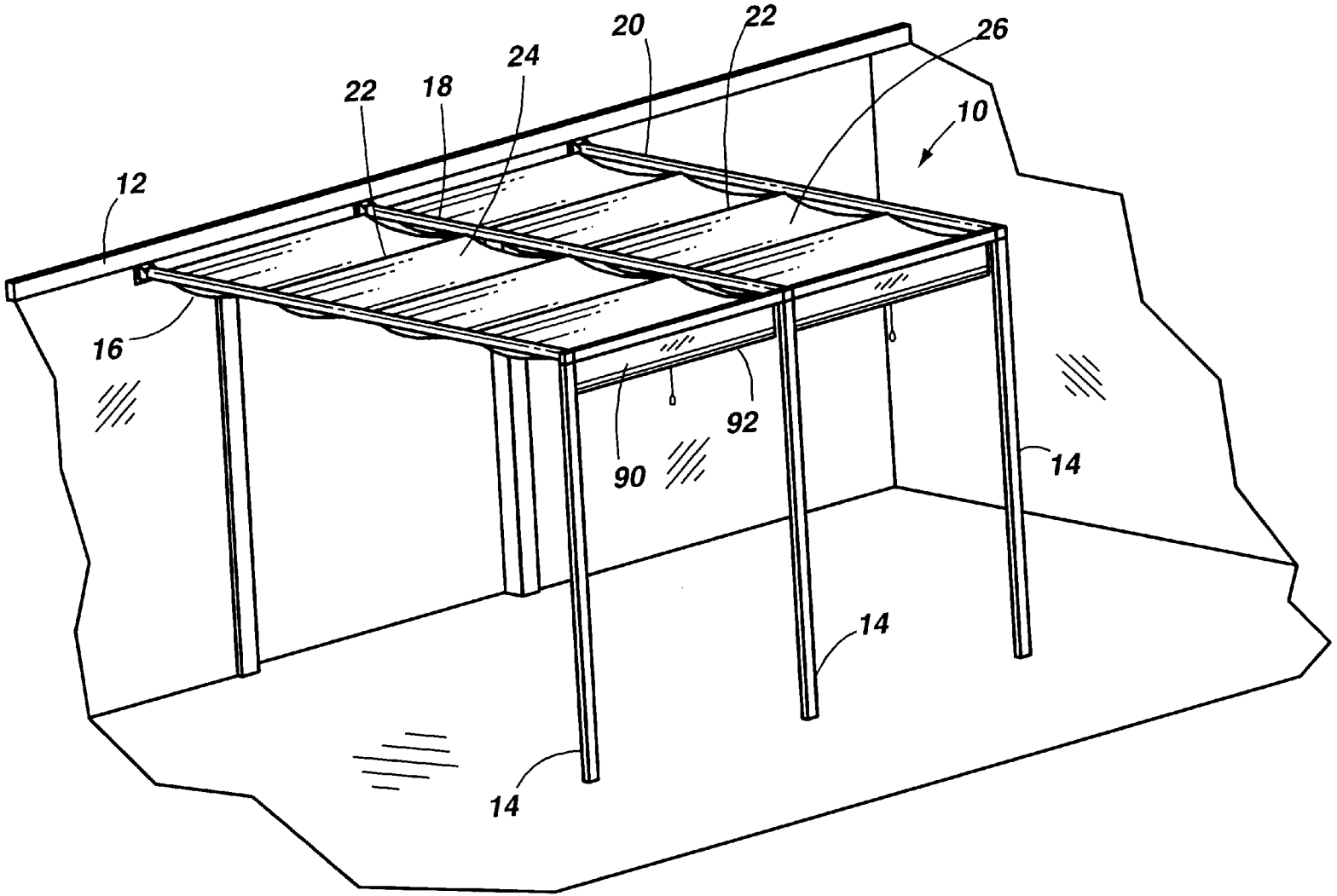
FIG. 1 is a view in perspective of an embodiment of the invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

FIG. 1 illustrates a canopy 10 embodying the present invention and mounted at one end to a building structure 12 and at its opposite end to vertical support posts 14. The frame portion of the canopy includes at least three substantially parallel, laterally spaced rafter members 16, 18 and 20, which are secured to the building structure 12 and to the posts 14. A plurality of movable cross beams 22 extend laterally between adjacent rafter members. Attached to each tier of cross beams, between each adjacent pair of rafter members, is a flexible opaque sheet, such as sheets 24 and 26, attached to the cross beams 22 at spaced intervals along the sheets 24 and 26. These laterally spaced sheets 24 and 26 provide the protective shade or sunscreen.

Figure 2:
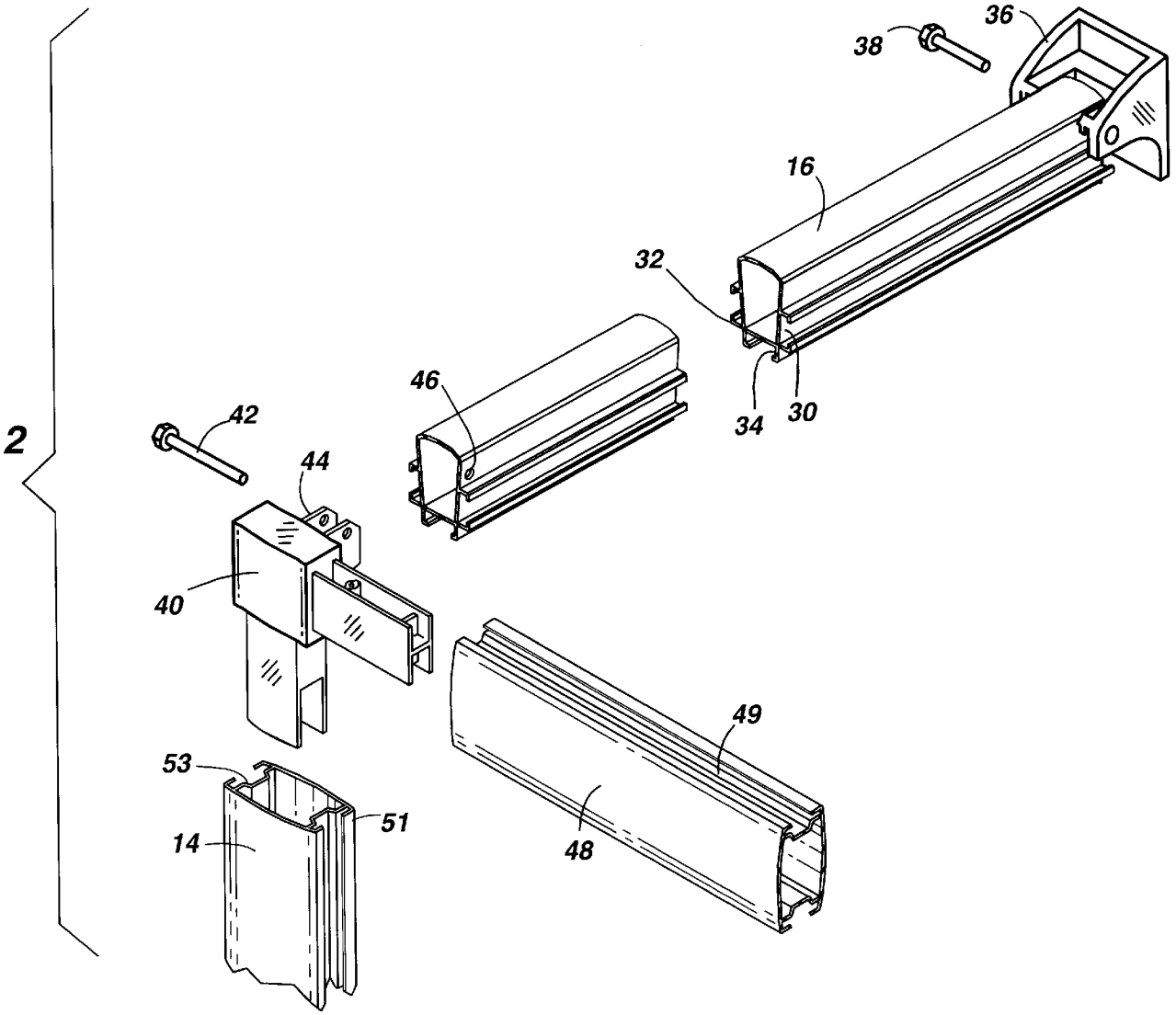
FIG. 2 is an exploded view in perspective illustrating the rigid frame members of the present invention.

FIG. 2 shows details of the rigid frame structure of the present invention. Each rafter member, such as the rafter member 16, has longitudinally extending tracks 30 and 32, extending on laterally opposite sides of the rafter member 16. The preferred frame members, and particularly the rafter members, are each formed in a unitary construction of extruded aluminum. The tracks 30 and 32 engage the ends of adjacent sheet-supporting cross beams. The preferred rafter member is also formed with a utility track 34 along its underside to support unrelated items, such as lighting and lighting wires, plants or other decorations. The tracks for supporting the cross beams may alternatively be located along the bottom surface of the rafter member 16 on laterally opposite sides of the bottom portion of the rafter member, although this is not preferred.

The rafter member 16 is preferably connected in a hinged or pivotal manner at each of its ends. For example, the rafter member 16 is hingedly attached to a wall surface bracket 36 by a bolt or pin 38 so the rafter member can pivot relative to the bracket. The opposite end is connected to a frame-joining bracket 40 for pivotal movement by the pin 42 extending through ears 44 and holes 46 at the end of rafter member 16.

This pivotal connection permits the canopy to be mounted at a slope inclined to horizontal at the precise angle which is both desired by the user and accommodates the building structure to which it is mounted. A fixed cross beam 48 provides lateral rigidity for supporting the rafter members and presents a finished end appearance. The fixed cross beam 48 is also provided with a utility track on its opposite sides, such as utility track 49, and one on the opposite side (not visible). Similar utility tracks 51 and 53 are additionally provided on opposite sides of the posts 14. These utility tracks allow for future support of lighting, flowerpots and other decorative items, as well as shades, valences or other accessories.

Figure 3:
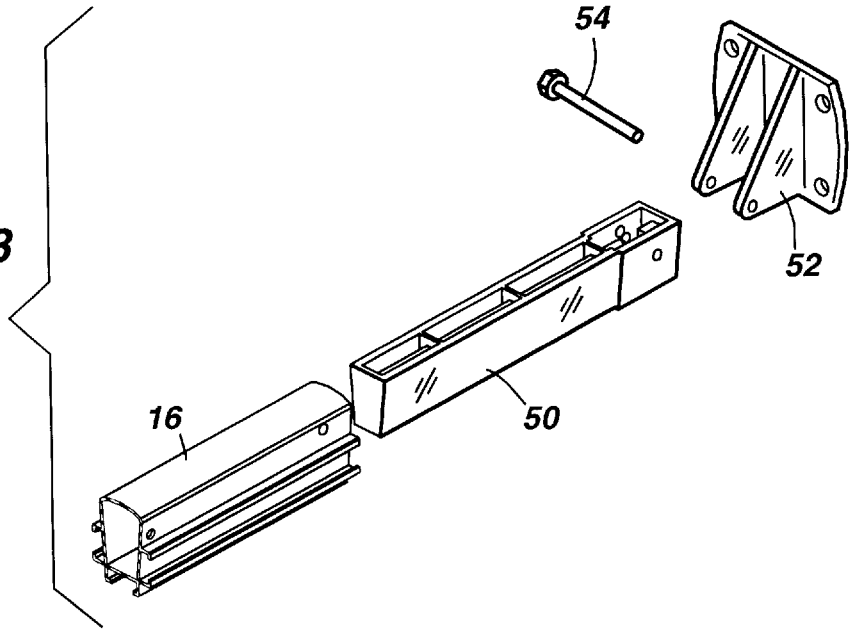
FIG. 3 is a view in perspective similar to FIG. 2 illustrating an alternative embodiment of the rafter member of FIG. 2 for extending the rafter member.

FIG. 3 illustrates an alternative structure for mounting the building structure end of the rafter member 16. This alternative uses an extender 50 which is pivotally mounted to the bracket 52 by a pin 54. The extender 50 is slidable within the rafter member 16 and is secured to it by a screw (not shown) engaged in aligned holes in the underside of the rafter member 16 and the extender 50. This permits the end of the rafter member 16 to be spaced from the building in order to accommodate variations in the contour of the building structure to which the rafter members are to be attached.

Figure 4:
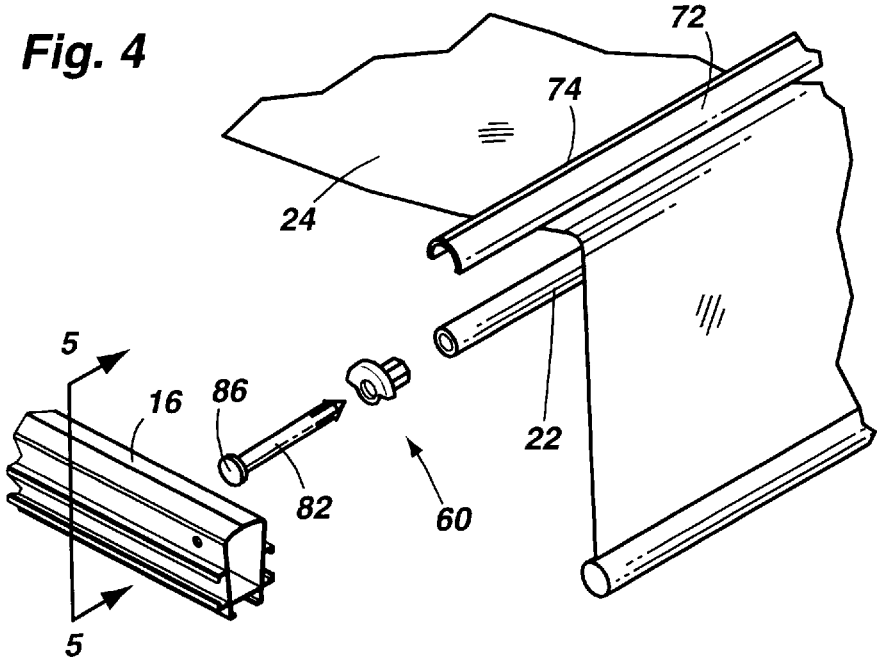
FIG. 4 is an exploded view in perspective illustrating the cooperation of the rafter members, cross beams, sheet material, and track engaging member of the present invention.
Figure 5:
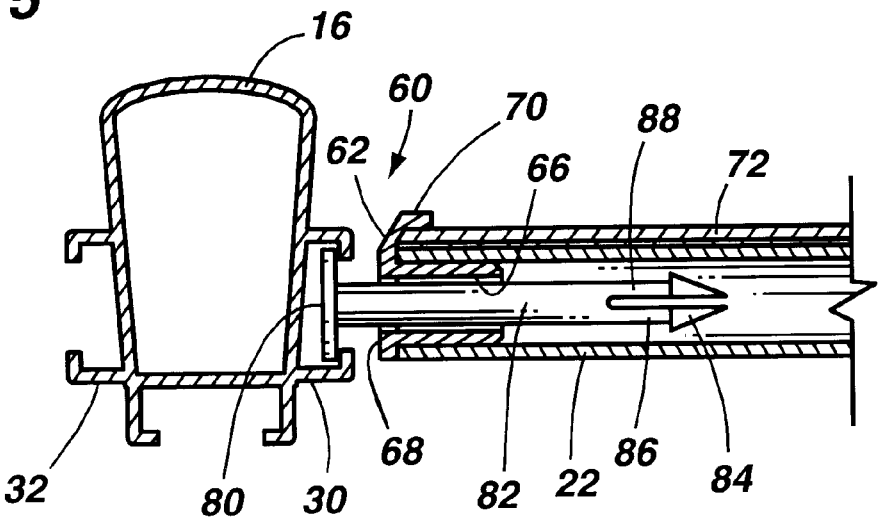
FIG. 5 is a view in vertical section taken substantially along the line 5—5 of FIG. 4, illustrating the cooperative engagement of the rafter member, the cross beam and its track-engaging member.
Figure 6:
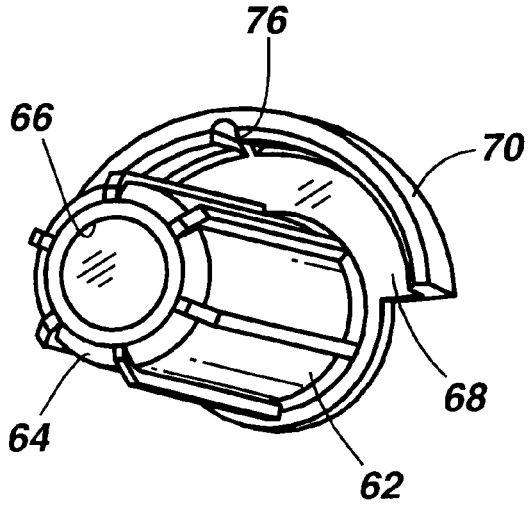
FIG. 6 is a view in perspective of the sleeve component of the track engaging structures.

FIGS. 4 and 5 illustrate the rafter member 16 and the cross beam structures which engage it. The preferred cross beam 22 is a metal or plastic tube. Each end of each cross beam 22 has a track-engaging member 60. The track-engaging member includes a sleeve 62, which is also illustrated in more detail in FIG. 6. The sleeve 62 has a finger portion 64 which frictionally engages the interior end of the tubular cross beam 22. A bore 66 parallel to the tubular beam, and preferably coaxial with it, is formed through the finger portion 64. The sleeve 62 also has an annular shoulder 68 extending radially beyond the periphery of the tubular cross beam 22 and an overhang 70 which is backturned to extend over an end of a channel-shaped sheet clamp 72.

The sheet clamp 72 attaches the sheet 24 to the cross beam 22. Each sheet clamp 72 is a resilient, channel-shaped clamp which partially surrounds a cross beam and resiliently clamps the sheet between the cross beam and the clamp. Preferably the cross beam 22 is a cylindrical tube and the channel-shaped clamp is a partial tube of larger radius. The clamp 72 extends matingly more than 180° around the cylindrical, peripheral surface of the cross beam 22 so that the clamp will be resiliently expanded outwardly when forced over the sheet 24 and cross beam 22. This removably but snugly holds the sheet in position on the cross beam. The inside diameter of the clamp 72 is approximately the same as the outside diameter of the tubular cross beam 22. Preferably the clamp 72 is provided with a longitudinal, protruding ridge 74 which seats in a corresponding slot 76 in the sleeve 62 for properly aligning the clamp 72 and preventing it from sliding rotationally around the cross beam 22.

The track engaging member further includes a wheel 80 located at the outer end of the sleeve 62 for engagement within the track 30. The wheel 80 is mounted to an axle 82 which extends through the hole 66 in the sleeve 60.

Although the wheel can be journalled to the axle in a conventional structure, preferably the wheel 80 is formed as a unitary body along with the axle 82, and is molded synthetic resin such as glass filled nylon. The diameter of the axle 82 is made sufficiently smaller than the sleeve bore 66 so that the axle is free to both rotate within and slide axially or laterally with respect to the sleeve 62. The axle 82 is provided with an enlarged interior end 84 for retaining the axle in the bore. However, the axle is made sufficiently long that it can slide a considerable distance, for example 2 inches, within the sleeve 60. This lateral sliding of the axle assures that the wheel will not bind in the tracks, even when the cross beams 22 are located at a substantial oblique angle to a perpendicular extending between the rafter members. This also prevents binding in the event that the spacing of the rafter members is not uniform with the result that the rafter members depart significantly from perfectly parallel.

Preferably the interior end of the axle comprises a plurality of interiorly extending fingers 86 and 88 and two fingers behind them which are hidden from view by them. Each finger has an outwardly extending, enlarged portion with an inclined end, each of which forms a segment of the enlargement 84 so that collectively they form the enlarged interior end of the axle. These fingers can conveniently be constructed by forming radial slots perpendicular to each other and extending axially into the end of the axle 82. In this manner the fingers are resiliently flexible and can deform inwardly to permit insertion of the axle 82 into the bore 66.

Figure 8:
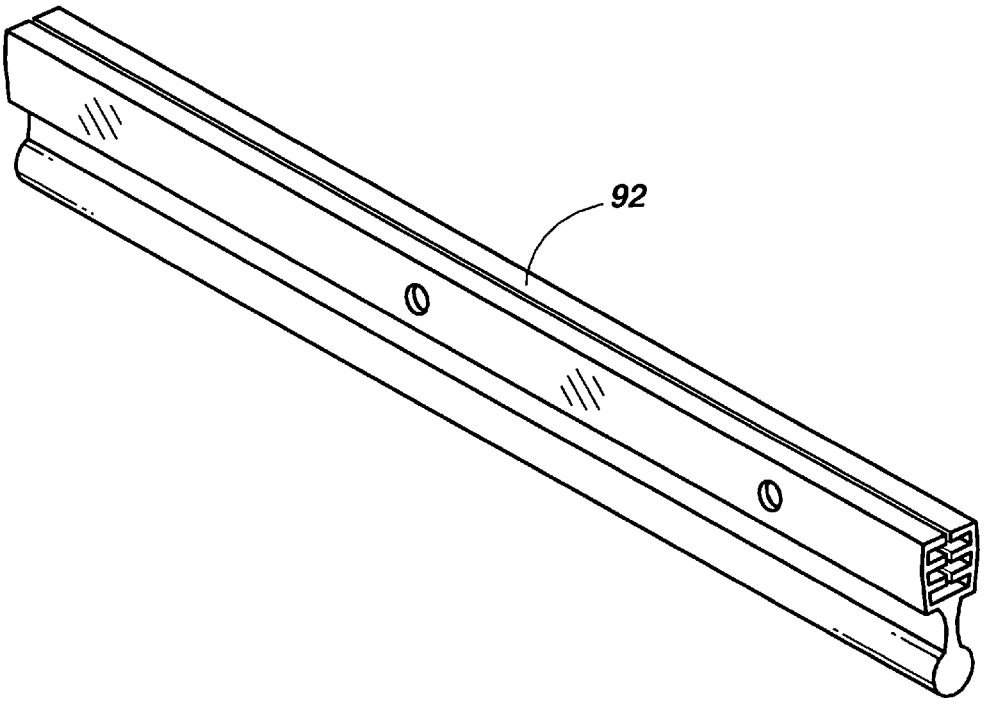
FIG. 8 is a view in perspective of an edge member for clamping to the end of each opaque sheet.

It is desirable that each sheet extend beyond the endmost cross beam so that the end will hang down and form an end curtain 90. The end curtain not only provides some vertical shading, but more importantly extends down to within convenient reach of a user. The end edge of the end curtain 90 is preferably provided with an edge member 92, illustrated in more detail in FIG. 8, which extends laterally across the end of the sheet 24 and is clamped to it to provide a hand grip. The edge member 92 has a finished appearance and distributes the tensile forces exerted on the end of the sheet 24 when the sheet is manually pulled into an extended or retracted position by the user.

Figure 7:
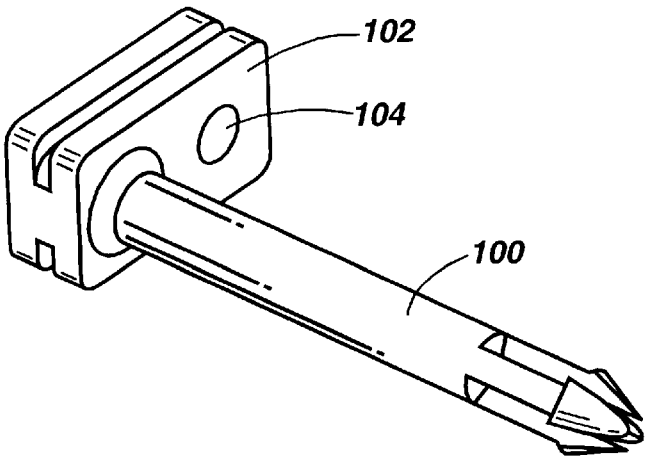
FIG. 7 is a view in perspective of a fixed end lock.

It is desirable that each opaque sheet be anchored near one end of each rafter member, preferably the end nearest the building structure, when the canopy of the present invention is attached to such a building structure. For this purpose, a fixed end lock is illustrated in FIG. 7. The fixed end lock has an axle portion 100, similar to the axle 82 of FIG. 5, but instead of having a wheel has a rectangular slide 102 which slides along the track and is fixed in position by a screw or other fastener, tightened through a threaded bore 104. This fixed end lock permits one endmost cross beam of each tier of cross beams to be slid into the desired position at which the screw through an end lock at each end of the cross beam is tightened to retain each endmost cross beam in position. This screw can later be loosened to permit subsequent readjustment.

Figure 9:
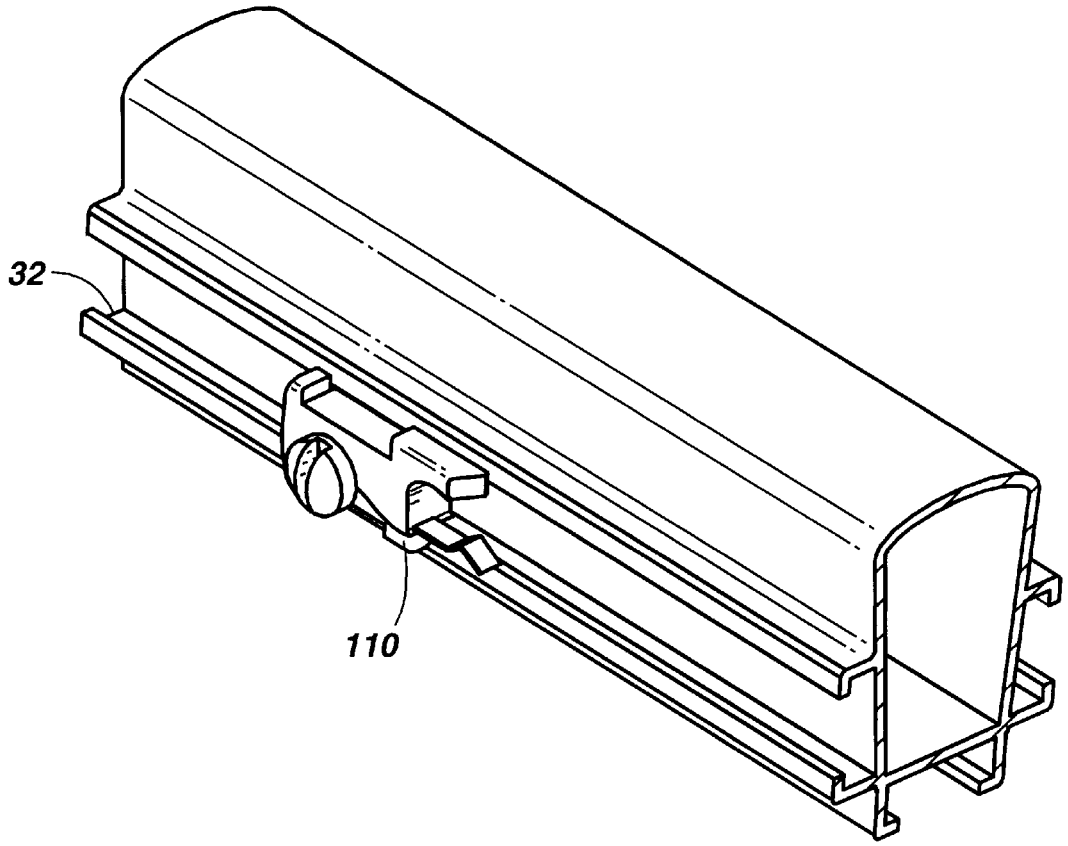
FIG. 9 is a view in perspective showing a releasable end lock mounted to the track of a rafter member.
Figure 10:
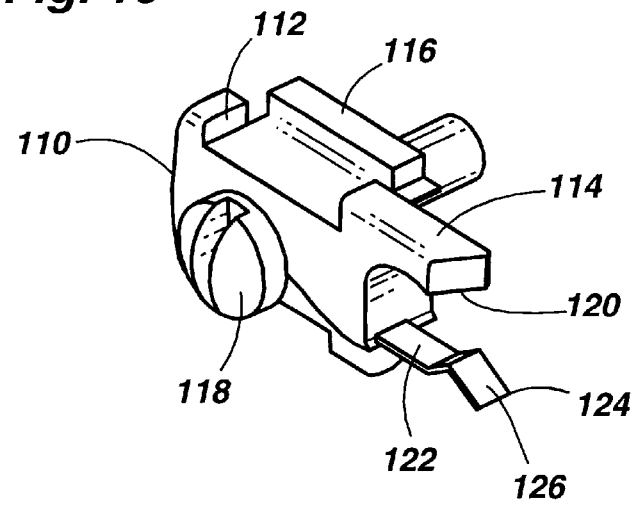
FIG. 10 is a view in perspective of the end lock of FIG. 9.

It is similarly desirable that the opposite endmost cross beams which are furthest from the building structure be held in position when the sheets are fully extended so that the sheets will extend between the cross beams in relatively shallow waves, rather than deep, large pleats, and so that the sheets remain extended. To accomplish this, a releasable end lock 110, illustrated in FIGS. 9 and 10, is mounted near at least one end of each track for retaining the endmost cross beam in the extended position when the sheet to which the cross beam is attached is tensioned to straighten the sheet. This releasable end lock 110, illustrated in FIGS. 9 and 10, has a channel formed between upstanding legs 112 and 114, which engage the exterior side of the track 32, and leg 116 which engages the interior side of track 32. The end lock 110 is adjustably positioned during installation and then retained in position by tightening down a screw 118, threadedly engaged in a bore through the releasable end lock 110 and seating against the bottom of the track 32 in the same manner as the fixed end lock of FIG. 7 is anchored in position.

The end of the endmost cross beam is releasably held in the releasable end lock 110 by seating within a U-shaped channel, formed by a rigid leg 120, and a resilient leg 122 of spring material. The resilient leg 122 has an upturned detent portion 124 for engaging and retaining the cross beam and a ramp portion 126 which allows a cross beam to be forced into the channel, deflecting the resilient finger 122 until the cross beam seats in the bottom of the channel.

Preferably the resilience or spring constant of the resilient member 122 is selected to permit comfortable insertion by a user, to retain the sheet in position in normal wind conditions, and to permit the sheet to be withdrawn by larger forces exerted by more extreme wind conditions which could potentially damage the sheet material.

Preferably a second releasable end lock is also positioned near the fixed end lock at the opposite end of each track. The second releasable end lock permits the user to releasably latch the endmost cross beam of each sheet in a fully retracted position.

Figure 11:
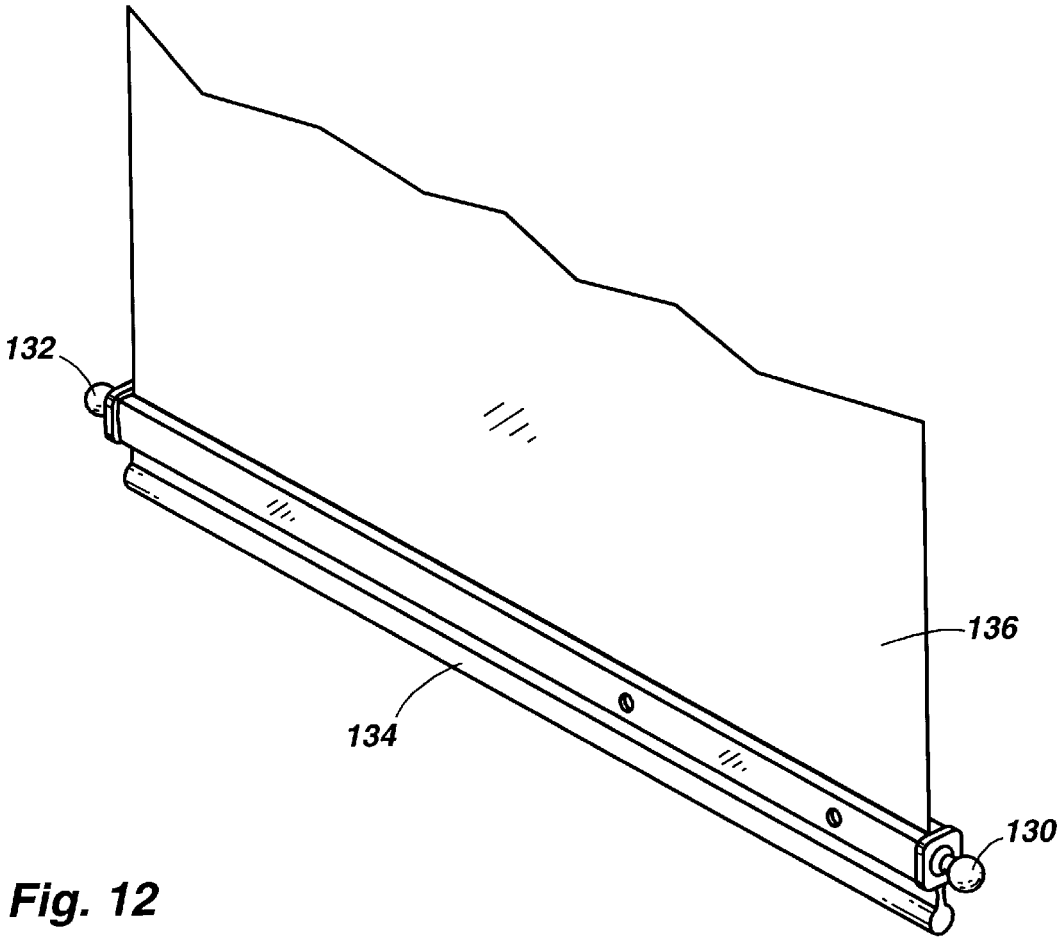
FIG. 11 is a view in perspective of an edge member having alternative ball detents for seating in sockets formed at the end of the rafter members.
Figure 12:
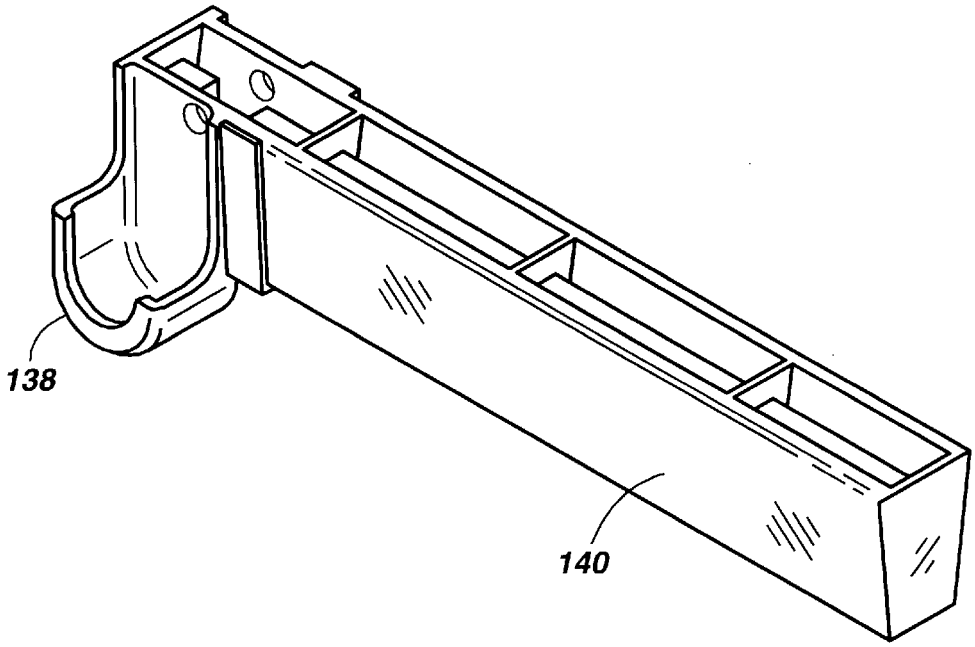
FIG. 12 is a view in perspective of an extender having a socket.

FIGS. 11 and 12 illustrate alternative ball detents mounted to the ends of an edge member which is clamped to the end of an end curtain 136. The purpose of the detents 130 and 132 is to provide a first latch member which permits the entire opaque sheet to be drawn to its fully retracted position and the end curtain 136 to be pulled underneath all the pleats formed between the cross beams and then latched in position to form a supporting sling. The edge member can be pulled snugly against the pleats to support them in a raised position and the edge member is then held in that position by seating the detents of the edge member in a second latch member preferably formed by sockets mounted near the end of the rafter member. This feature holds the pleats at a higher elevation so they do not obstruct any pivoting doors which might be located on the building structure below the end of the installed canopy 10 and provides a more aesthetic appearance.

FIG. 12 shows a socket 138 formed or mounted at the end of an extender 140 constructed similarly to the extender 50 illustrated in FIG. 3 and attached to a rafter member in the same manner. The socket 138 forms a cradle which receives and supports the ball detent 130 and therefore the end edge member and end curtain attached to it. Of course, other attachment structures can be used to attach the edge member and suitable sockets or other attachment structures can alternatively be mounted directly to the rafter members, for example by mounting them to the tracks formed on the rafter members.

The cross beams and the sheets mounted to them are freely slidable along the tracks of the rafter members. Therefore at least one of the cross beams must be anchored to the track or at least one of the ends of each track must be blocked to prevent the sheets from being slid out the end of the track. The end locks perform this function.

The rafter members and their tracks can be formed either in a curved contour or can be formed as a rafter having two linear components intersecting at an angle. This allows more end shade by creating a side or end curtain effect.

Embodiments of the present invention are inexpensive to purchase and install because they utilize no sophisticated mechanisms, requiring no winding or rolling of the sheet material. To extend or retract the sheets, the user simply reaches up and grasps the edge member 92, which may additionally be provided with a handle, and draws each entire sheet, along with its attached cross beams, to whatever extension the user wishes. The user may position the sheet at any intermediate position or may draw it to a fully extended position and lock it in place into the releasable end locks.

An additional advantage of the present invention is that the sheet material requires no sewing or stitching and therefore eliminates these potentially expensive manual labor steps. Unlike other shade systems, embodiments of the present invention can utilize a sheet material of a standard width and does not require a plurality of ribbons of fabric or other sheet-like material to be sewn together or to be sewn to other supporting structures.

Figure 13:
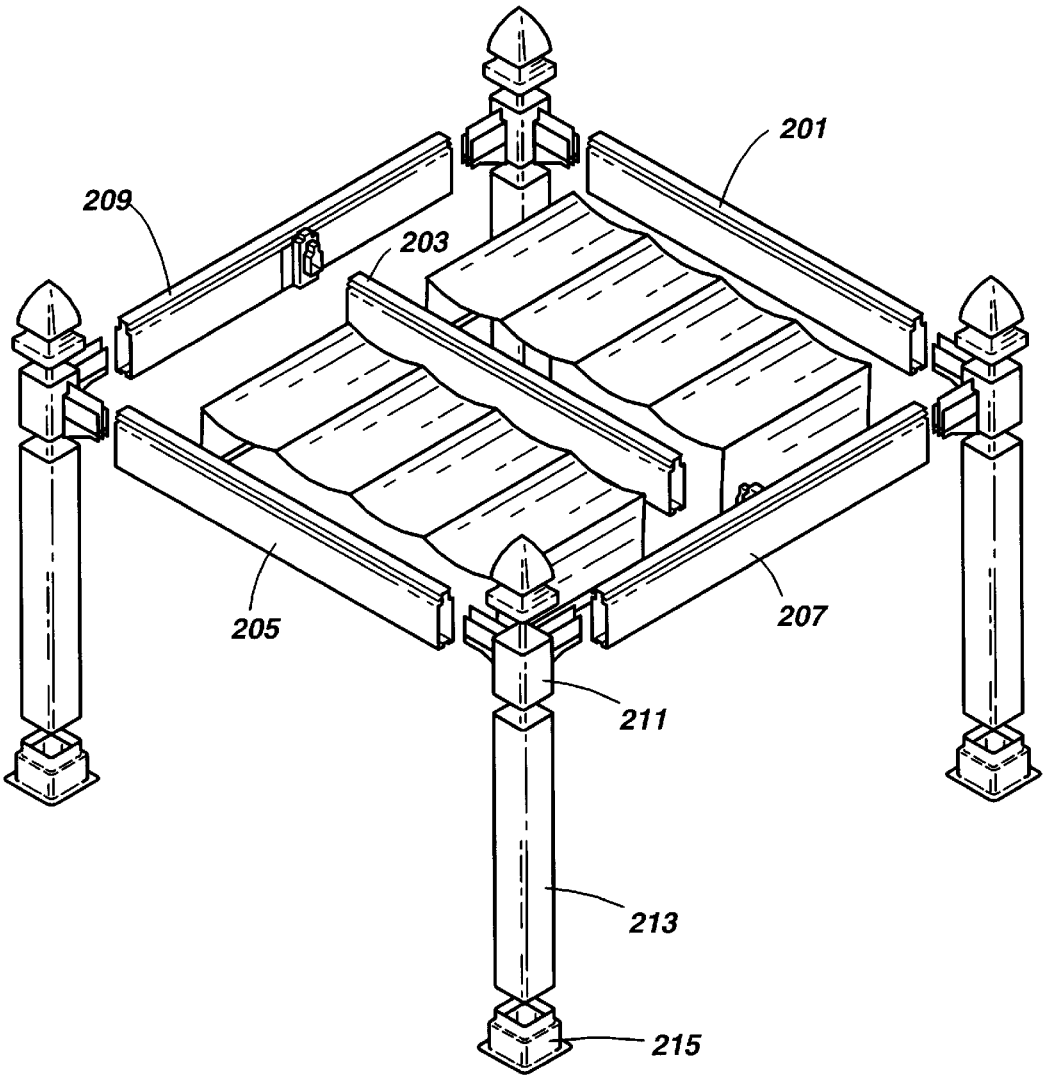
FIG. 13 is an exploded view of an improved, freestanding embodiment of the invention.

FIG. 13 illustrates an improved embodiment of the invention, having rafter members 201, 203 and 205, which are joined to front member 207 and back member 209 by corner fittings 211. Each corner fitting is supported on a vertical post, such as post 213, which in turn is supported on a base fitting 215.

Figure 14:
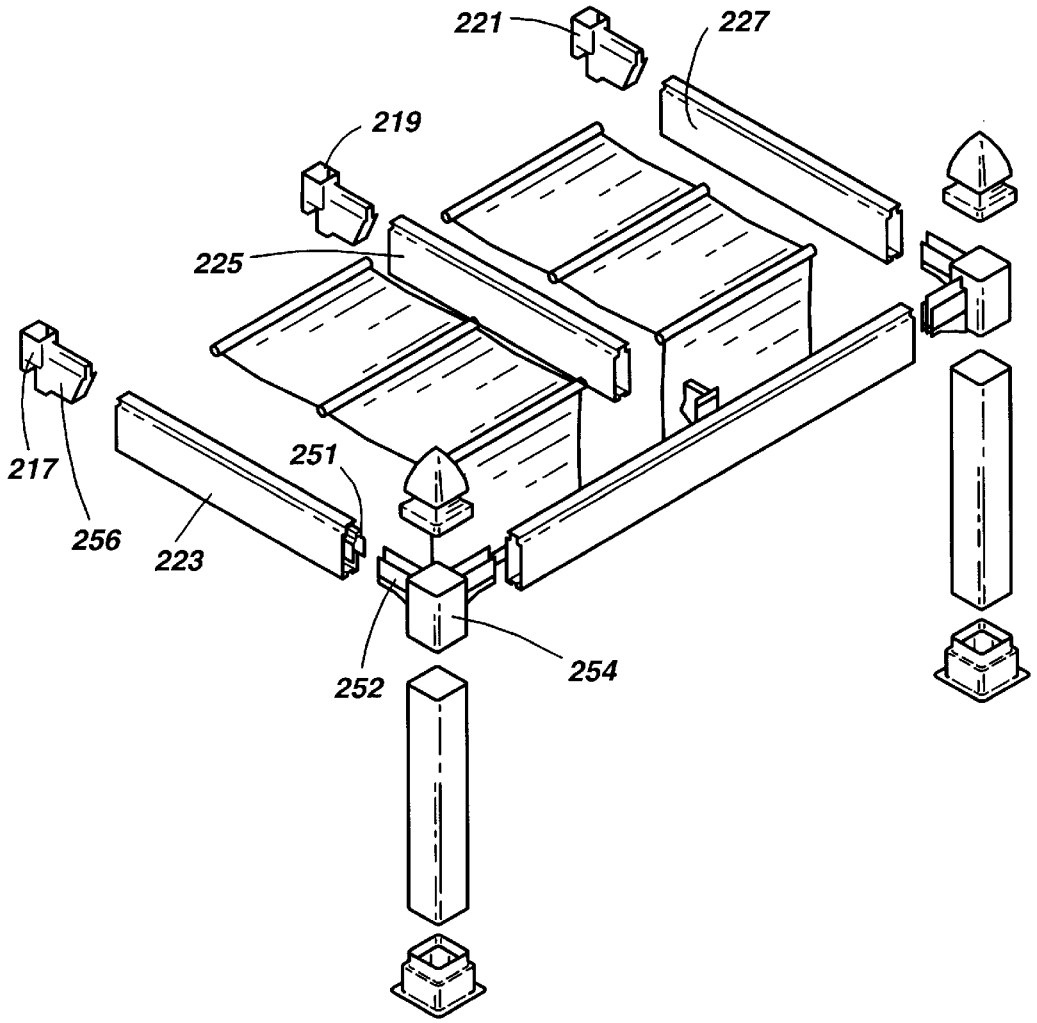
FIG. 14 is an exploded view of an improved embodiment for attachment to an existing building.

FIG. 14 illustrates a canopy embodying the present invention, but having wall brackets 217, 219 and 221 for attaching the rafter members 223, 225 and 227 to an existing building structure. Extenders 218, 220 and 222 are attached to the wall brackets.

Figure 15:
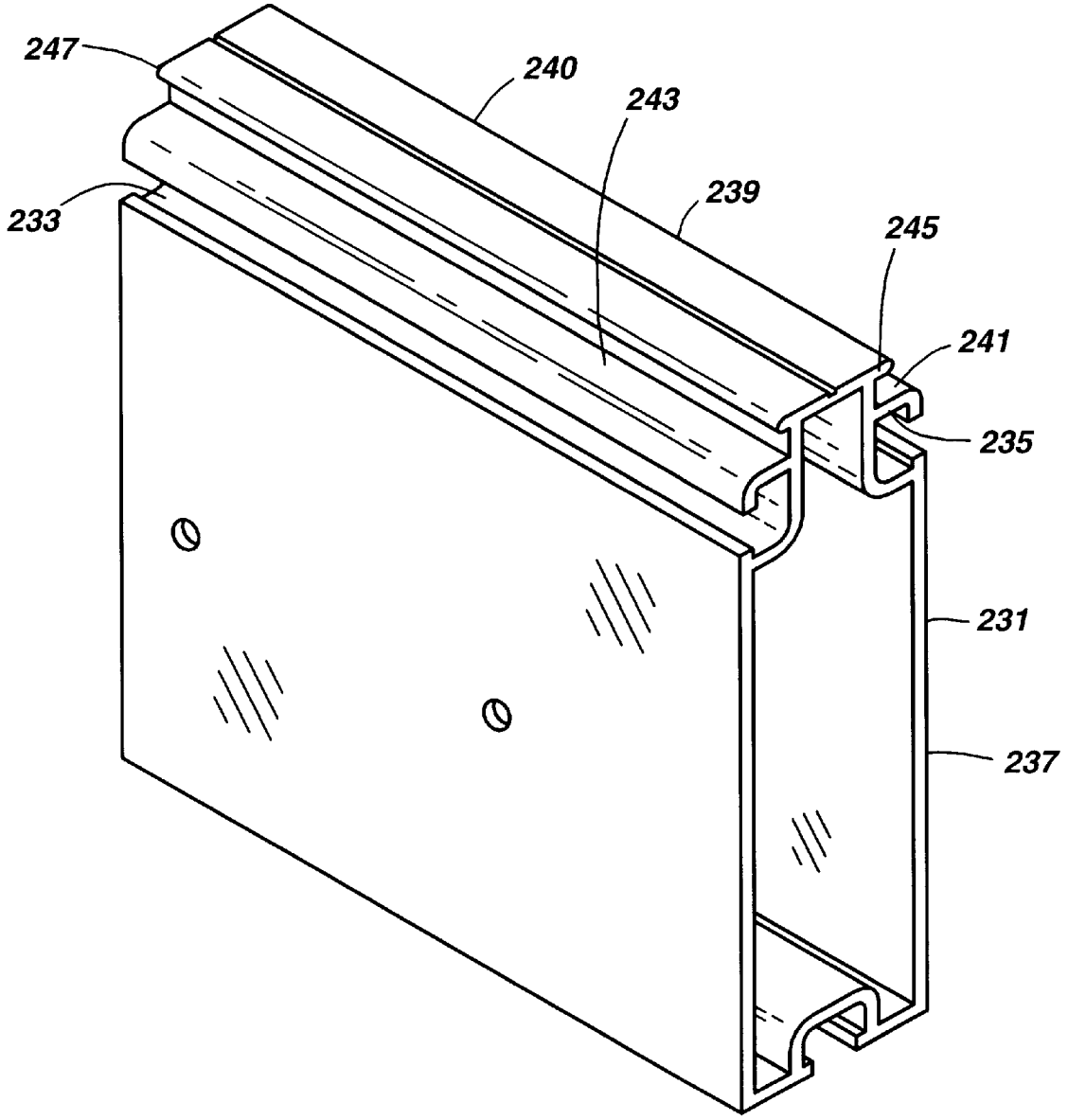
FIG. 15 is a perspective view of a portion of an extruded rafter member embodying the present invention.

FIG. 15 illustrates in more detail the cross-sectional structure of the rafter members illustrated in FIGS. 13 and 14. The rafter member comprises an extruded, synthetic resin (plastic) tube 231, formed, for example, of PVC (polyvinylchloride). The tube 231 has oppositely opening channels 233 and 235, formed longitudinally along opposite sides of the tube 231 to form tracks. The track engaging members (previously described) at the ends of each of the cross beams are freely, manually moveable along these tracks. Preferably, the tube 231 has a generally rectangular cross-section for its lower portion 237 and a narrower, upwardly and longitudinally extending ridge 239 along the top portion of the generally rectangular lower portion 237. Laterally extending flanges 241 and 243 each form the upper side of the oppositely opening tracks, with the lower side of the tracks being formed by the upper side of the generally rectangular lower portion 237 of the tube 231. Preferably the flanges 241 and 243 are spaced downwardly from the top-most side 240 of the ridge 239.

A pair of longitudinally extending, laterally protruding ribs 245 and 247 are formed along the top-most side 240 of the ridge 239 for retaining an end lock of the type described below. These protruding ribs 245 and 247 form a track along the top of the tube 231 for engaging and retaining the end lock.

Figure 16:
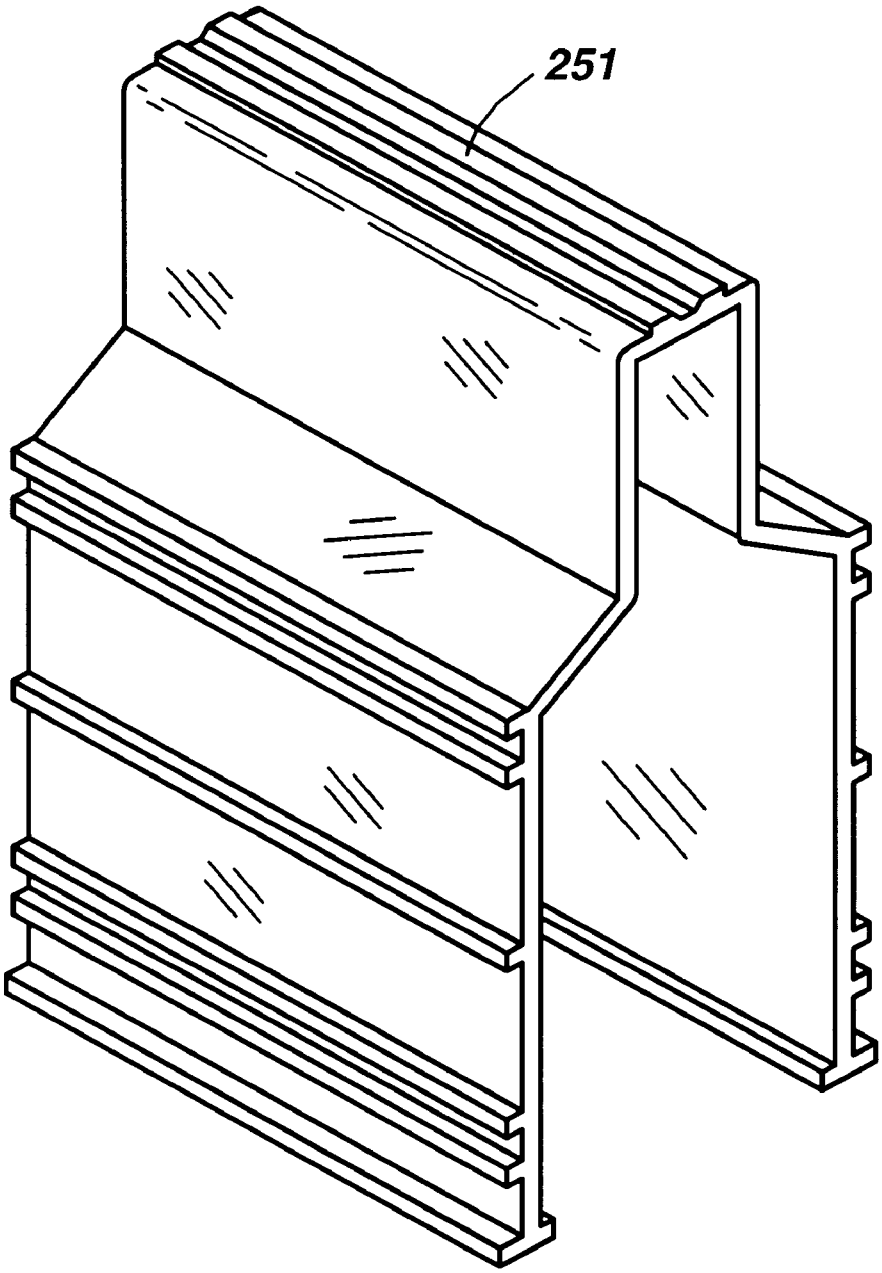
FIG. 16 is a view in perspective of a portion of an extruded aluminum-reinforcing beam, which is used in the preferred embodiment of the invention.

Preferably, but not necessarily, each rafter member further comprises an extruded aluminum reinforcing beam 251, which is visible in FIG. 14 and illustrated in more detail in FIG. 16. The reinforcing beam 251 is telescopically enclosed within the synthetic resin tube 231, as illustrated in FIG. 14. The preferred extruded aluminum reinforcing beam 251 has a generally, downwardly opening U-shaped channel and conformably telescopically slides within the extruded synthetic resin tubes. The use of the combination of the synthetic resin tube and an aluminum reinforcing beam enhances the strength of the rafter members, while also providing a smooth, non-corrosive outer surface, more color options and quieter tracks than metal rafter members would provide. The reinforcing beams receive and are supported by extensions on the corner fittings, such as extensions 252 on corner fitting 254, and by the extenders, such as extender 256 on wall bracket 217.

Figure 17:
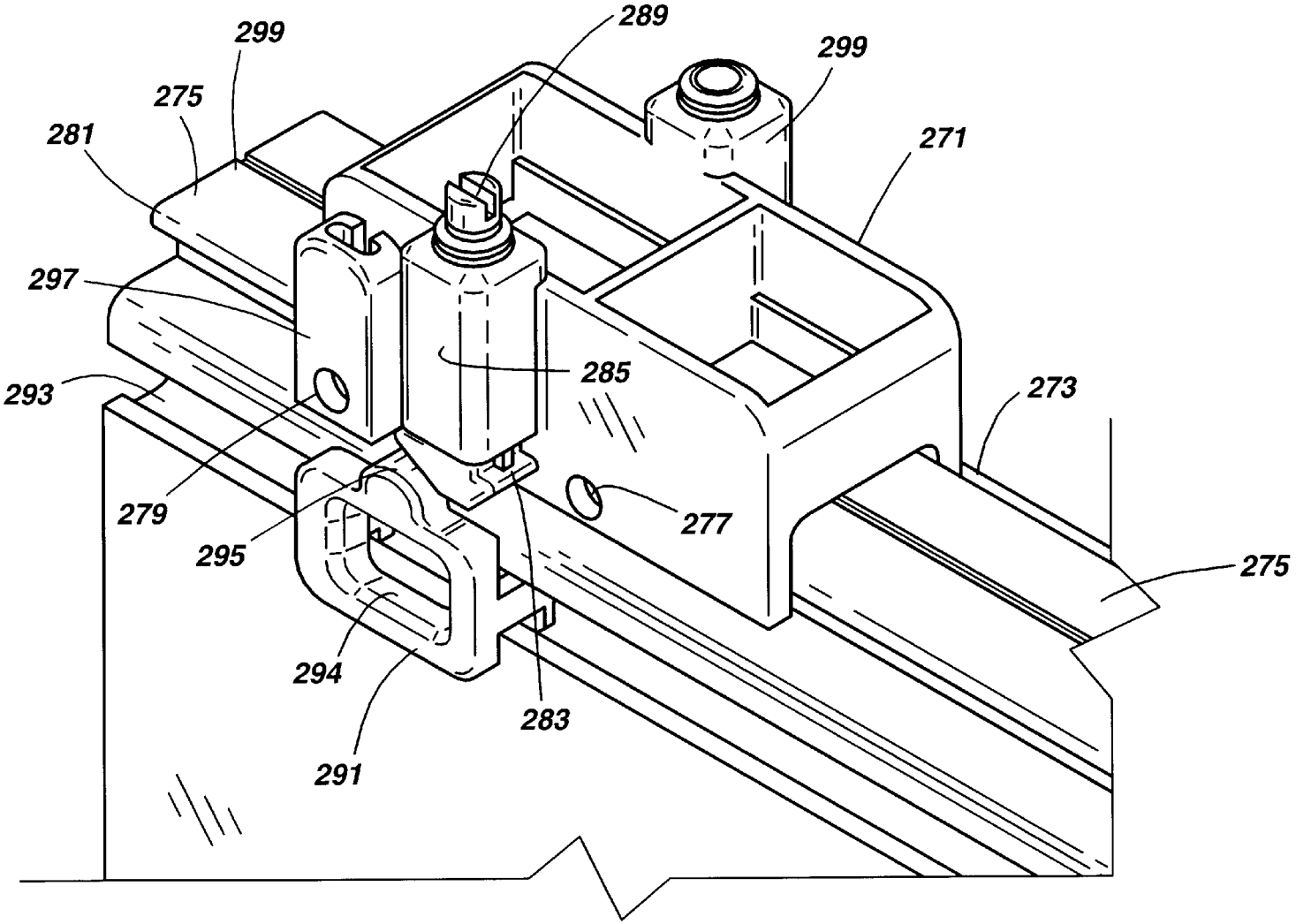
FIG. 17 is a view in perspective illustrating an end lock used in embodiments of the present invention.
Figure 18:
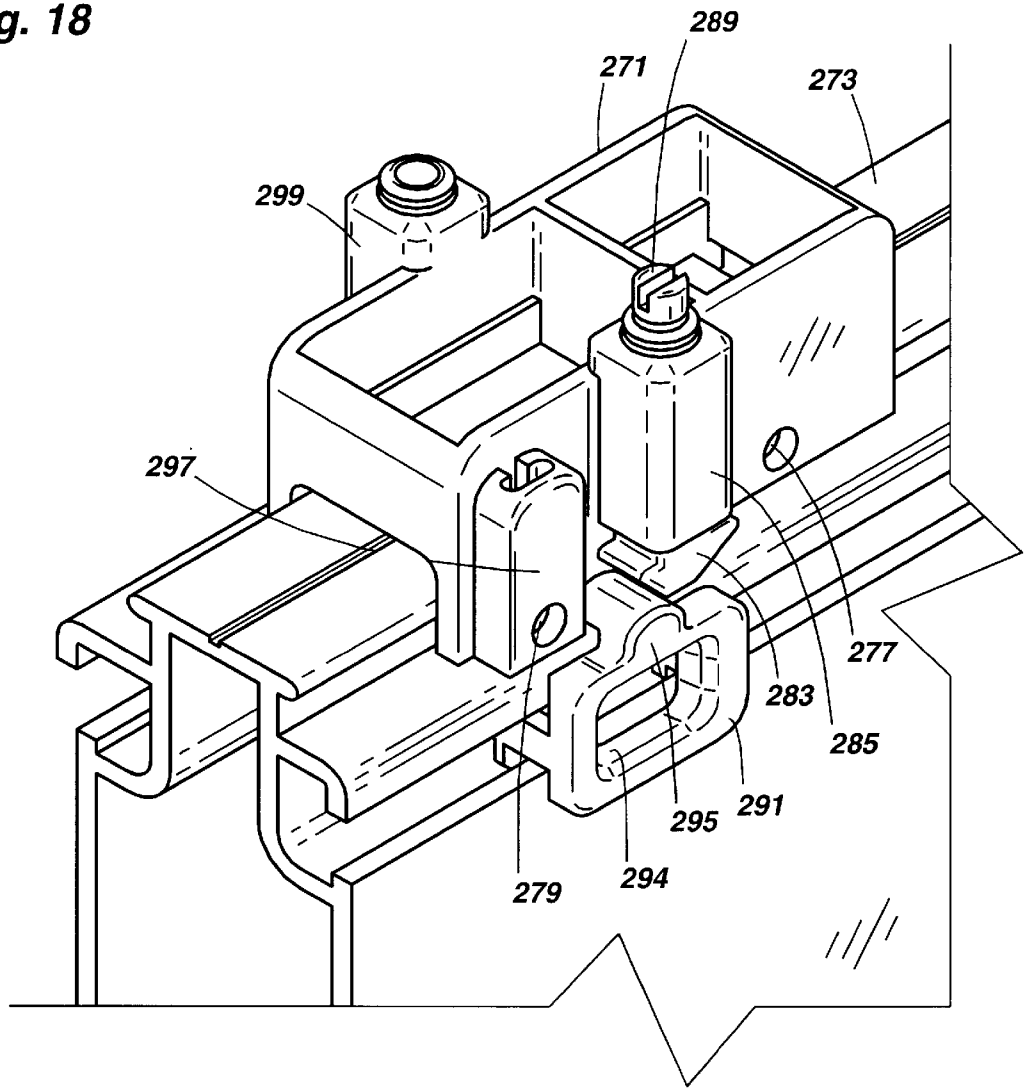
FIG. 18 is an additional perspective view of the end lock of FIG. 17.
Figure 19:
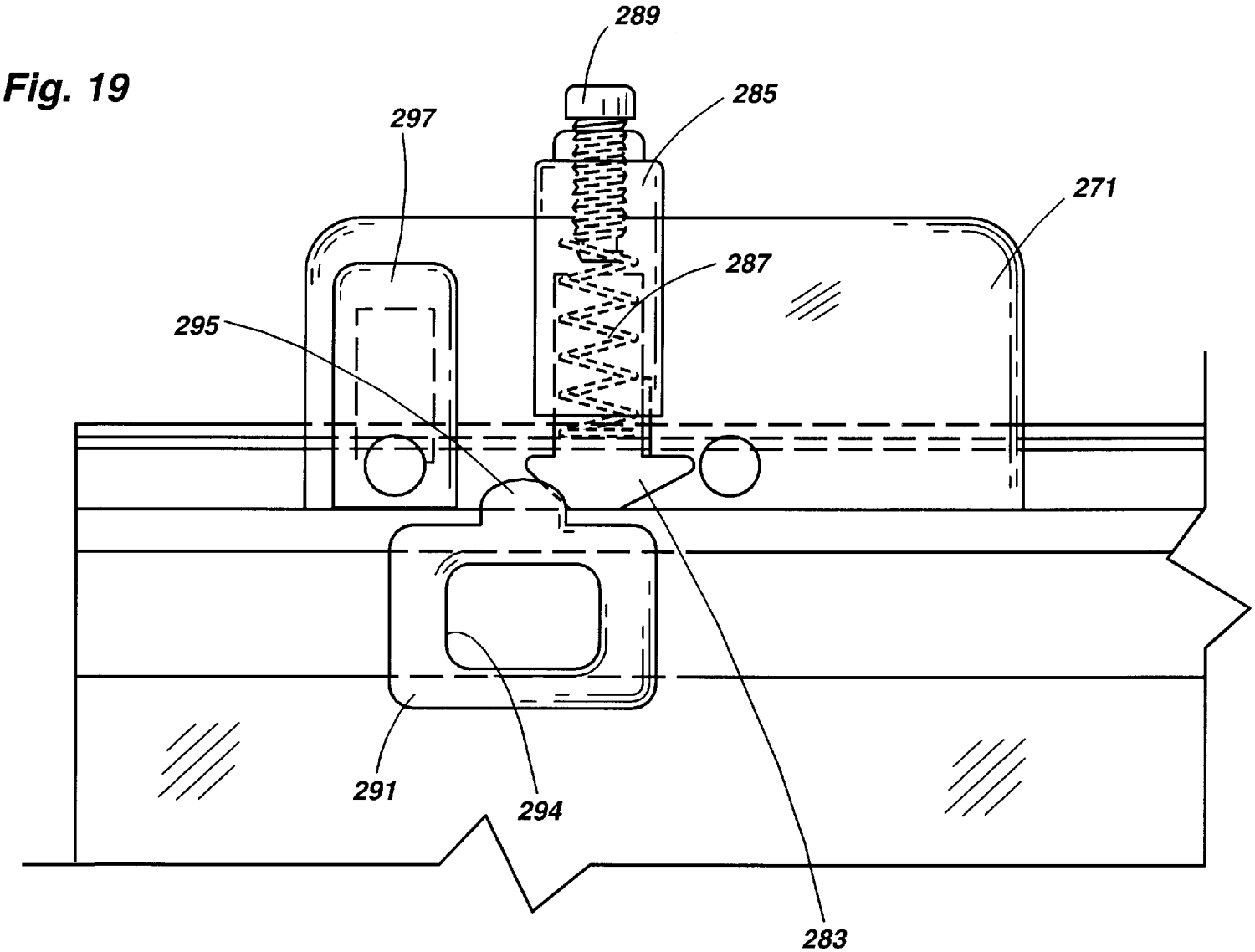
FIG. 19 is a view inside the elevation of the end lock of FIG. 17.

FIGS. 17, 18 and 19 illustrate various views of an improved end lock for use as a part of embodiments of the present invention. The end lock has a lock mounting bracket 271, mounted to the rafter member 273, preferably on the ridge 275. At least one and preferably two set screws 277 and 279 are threadedly engaged to the lock bracket 271 for seating against the ridge to secure the lock bracket 271 at a selected, longitudinal position along the rafter member 273. Preferably the set screws 277 and 279 engage the ridge below the ribs formed on the rafter member 273, such as rib 281. The ribs prevent the lock bracket 271 from being lifted upwardly by a force sufficient to cause the innermost ends of the set screws to cut through the synthetic resin of the rafter member 273.

The end lock carries a vertically movable detent 283, which is matingly slidable in a detent receptacle 285. The detent 283 engages a helical, biasing spring 287 (visible in FIG. 19) mounted within the detent receptacle 285. One end of the spring 287 seats against a horizontal wall of the detent 283 and the opposite end of the spring 287 seats against an adjustment screw 289. Rotation of the adjustment screw 289, which is threadedly engaged to the detent receptacle 285, permits adjustment of the force applied to the detent. This adjustment allows the adjustable selection of the wind induced force on the flexible sheets, which causes their release by the end lock in the event of an excessive wind.

A slide lock 291 is slidable within the channel 293, which forms a track in which the track engaging members of the cross beams also slide. Each slide lock 291 is formed with an opening 294 to receive an end of a track engaging member, including, for example, a wheel described above, attached to the end of the cross beam. The slide lock 291 also has an upwardly extending boss 295 for engaging the detent 283. A stop 297 is attached to the lock bracket 271, preferably by the screw 279, so that the slide lock carrying the cross beam may be slid past the releasable detent 283 and trapped between the stop 297 and the detent 283.

In the event of a wind force being applied to the sheets carried by the cross beams, the cross beam which engages the slide lock 291 will pull the slide lock 291 against the detent 283, and if the force is sufficient will cause release by forcing the detent upwardly by a cam action and releasing the slide lock 291.

Preferably the end lock additionally carries a second movable detent on the opposite side of the rafter member 273 carried in a second detent receptacle 299, and constructed identically to the previously described detent mechanism.

While certain preferred embodiments of the present invention have been disclosed in detail, it is to be understood that various modifications may be adopted without departing from the spirit of the invention or scope of the following claims.

We claim:

1. A canopy comprising:

(a) at least three, substantially parallel, laterally spaced rafter members forming a plurality of laterally spaced openings between the rafter members, each rafter member having a pair of longitudinally extending tracks;

(b) a plurality of movable cross beams extending laterally only between adjacent rafter members, each cross beam having a track-engaging member attached to each end, slidable along a track and freely manually movable along the track, two adjacent tiers of cross beams being independently slidably engaged with tracks of one of the rafter members; and (c) a plurality of flexible opaque sheets, each sheet between and extending longitudinally along adjacent rafter members, each sheet extending laterally only between adjacent rafter members and attached to cross beams at spaced locations along the sheet.

2. A canopy in accordance with claim 1 further comprising an end lock near at least one end of each track for releasably retaining a cross beam in position when the sheet to which the cross beam is attached is tensioned and releasing the endmost cross beam in response to a potentially destructive tension for providing wind damage protection, the end lock further comprising:

(a) a lock bracket slidably mounted to a rafter member;

(b) at least one set screw for securing the lock bracket in a selected position along the rafter member;

(c) a movable detent engaging a bias spring having a force adjustment; and (d) a slide lock which is slidable along the rafter into engagement with the detent and engaging an end of a cross beam.

3. A canopy in accordance with claim 2 wherein the bias spring is a helical spring.

4. A canopy in accordance with claim 2 wherein the end lock further comprises a second movable detent on the opposite side of the rafter member engaging a second bias spring having a force adjustment and a second slide lock which is slidable along the rafter member into engagement with the second detent and engaging an end of a different cross beam.

5. A canopy in accordance with claim 1 wherein rafter members comprise: an extruded, synthetic resin tube having channels formed longitudinally along its opposite sides forming said tracks.

6. A canopy in accordance with claim 5 wherein the tube further comprises a track formed along a top of the tube for engaging and retaining an end lock near at least one end of a track for releasably retaining a cross beam.

7. A canopy in accordance with claim 5 wherein the rafter member further comprises an extruded aluminum reinforcing beam telescopically enclosed within the synthetic resin tube.

8. A canopy in accordance with claim 7 wherein the reinforcing beam has a downwardly opening unshaped cross section in its operable position.

9. A canopy in accordance with claim 5 wherein the synthetic resin tube further comprises a generally rectangular cross section having a narrower, upwardly and longitudinally extending ridge and laterally extending flanges forming one side of said track.

10. A canopy in accordance with claim 9 wherein the flanges are spaced downwardly from the topmost edge of the ridge and a pair of longitudinally extending, laterally protruding ribs are formed along the topmost edge of the ridge for retaining an end lock near at least one end of each track for releasably retaining a cross beam in position when the sheet to which the cross beam is attached is tensioned and releasing the endmost cross beam in response to a potentially destructive tension for providing wind damage protection.

11. A canopy in accordance with claim 10 wherein said end lock further comprises:

(a) a lock bracket slidably mounted to a rafter member upon said ridge; (b) at least one set screw for securing the lock bracket in a selected position along the rafter member and engageable with the ridge of the rafter member below the rib;

(c) a movable detent engaging a bias spring having a force adjustment; and (d) a slide lock which is slidable along the rafter into engagement with the detent and engaging an end of a cross beam.

* * * * *